United States Patent [19]

Loock

[11] Patent Number: 4,925,222

[45] Date of Patent: May 15, 1990

[54] DOOR LATCH ACTUATING MECHANISM

[75] Inventor: Freidrich Loock, Brakel, Fed. Rep. of Germany

[73] Assignee: Adams Rite Manufacturing Co., City of Industry, Calif.

[21] Appl. No.: 237,182

[22] Filed: Aug. 29, 1988

[51] Int. Cl.[5] ..... E05B 3/00

[52] U.S. Cl. ..... 292/336.3; 292/347; 292/DIG. 61

[58] Field of Search ..... 292/336.3, 347, 169.23 X, 292/337, 357, DIG. 61

[56] References Cited

U.S. PATENT DOCUMENTS

| | | | |
|---|---|---|---|
| 2,661,977 | 12/1953 | Welch et al. | 292/336.3 |
| 2,899,228 | 8/1959 | Polchinski et al. | 292/336.3 |
| 3,011,330 | 12/1961 | Eads . | |
| 3,011,817 | 12/1961 | Eads . | |
| 3,038,748 | 6/1962 | Brady | 292/336.3 |
| 3,041,100 | 6/1962 | Brady | 292/336.3 |
| 3,126,217 | 3/1964 | Russell et al. | 292/336.3 |
| 3,183,740 | 5/1965 | Legge | 292/336.3 |
| 3,212,806 | 10/1965 | Russell et al. | 292/336.3 |
| 3,368,374 | 2/1968 | Eads . | |
| 3,689,159 | 3/1975 | Eads . | |
| 4,218,903 | 8/1980 | Eads . | |
| 4,458,928 | 7/1984 | Hirschbein . | |
| 4,790,583 | 12/1988 | Tönsmann et al. | 292/336.3 |

FOREIGN PATENT DOCUMENTS

| | | | |
|---|---|---|---|
| 904970 | 9/1962 | United Kingdom | 292/336.3 |
| 985403 | 3/1965 | United Kingdom | 292/336.3 |
| 1528521 | 10/1978 | United Kingdom | 292/336.3 |

*Primary Examiner*—Gary L. Smith
*Assistant Examiner*—Michael Milano
*Attorney, Agent, or Firm*—William W. Haefliger

[57] ABSTRACT

A door latch actuating mechanism comprises: a housing attachable to door structure, a handle carried by the housing for rotation in either of two directions, and an output shaft rotatable in response to handle rotation, and mechanism in the housing to yieldably resist handle rotation in either direction, the mechanism including (i) a rotor coupled to the handle to rotate therewith,
(ii) a first spring coupled to the rotor to resist rotor rotation in one direction, and
(iii) a second spring coupled to the rotor to resist rotor rotation in the opposite direction.

9 Claims, 4 Drawing Sheets

DOOR LATCH ACTUATING MECHANISM

BACKGROUND OF THE INVENTION

This invention relates generally to door latch actuators, and more particularly to an improved actuator enabling installation in different configurations to enable opening of the latch when the door handle is swung either clockwise or counterclockwise.

There is need for simple, rugged, easily assembled and disassembled door latch actuators enabling installation and operation as referred to above. There is also need for an improved door latch actuator assembly wherein handle return springs are utilized, and characterized in that one spring may be substituted for another in the event of failure of a particular spring. Also, there is need for an improved assembly enabling anodizing of the exterior metallic surface of the assembly, the interior of the unit consisting of a high strength material which is not anodizable.

SUMMARY OF THE INVENTION

It is a major object of the invention to provide an improved door latch actuator assembly meeting one or more of the above needs, and preferably all such needs. The basic assembly includes:

(a) a housing attachable to door structure, (b) a handle carried by the housing for rotation in either of two directions, and an output shaft rotatable in response to handle rotation, (c) and mechanism in the housing to yieldably resist handle rotation in either direction, said mechanism including:

(i) a rotor coupled to the handle to rotate therewith, (ii) a first spring coupled to the rotor to resist rotor rotation in one direction, and (iii) a second spring coupled to the rotor to resist rotor rotation in the opposite direction.

It is another object of the invention to provide coupling of the springs to different portions of the rotor, whereby the second spring is inactive when the rotor is rotated in said one direction, and said first spring is inactive when the rotor is rotated in said opposite direction. As will appear, the springs are typically compression type springs which extend longitudinally in laterally spaced relation, within a re-entrant recess formed by a molded plastic insert within the external shell.

It is another object to provide a channel-shaped metallic bracket within the shell and interfitting the molded insert to contain the springs and rotor, and in such manner that removal of the shell off the insert and bracket, as by displacement over the handle, enables disassembly of the bracket and insert to expose the springs enabling substitution of one for the other. The shell is preferably metallic and thin-walled, to be anodizable, while strength is provided by the bracket and insert within the shell.

Yet another object is the provision of plungers extending between the ends of the respective springs and said cam shoulders defined by the rotor, the cam shoulders located at opposite sides of the rotor axis.

Still another object is the provision of a trim plate that is anodizable, which covers the open end of the shell, as well as an opening cut in a door that receives a latch actuating shaft on the rotor.

These and other objects and advantages of the invention, as well as the details of an illustrative embodiment, will be more fully understood from the following specification and drawings, in which:

DRAWING DESCRIPTION

DETAILED DESCRIPTION

Figure 11:
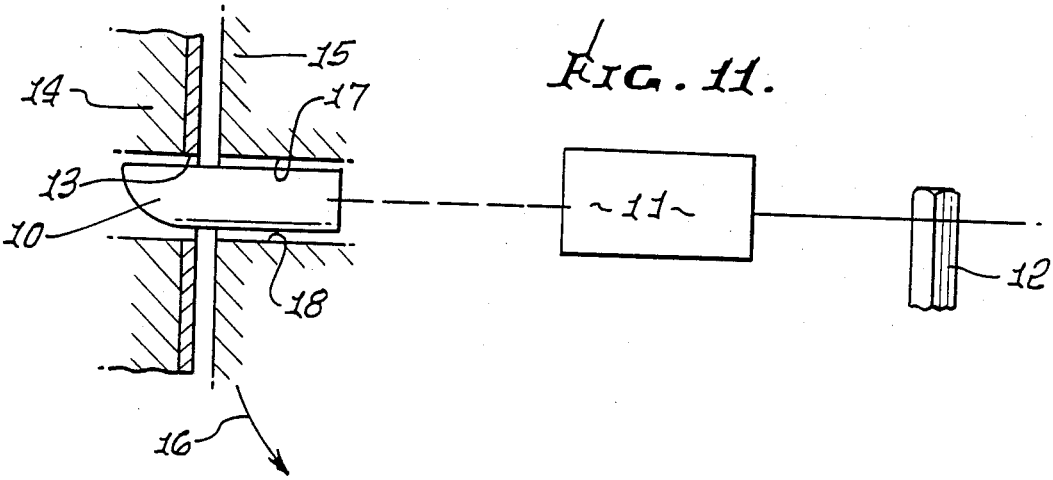
FIG. 11 is side view showing attachment of the FIGS. 1-10 device to a door, in door latch actuating position.

Referring first to FIG. 11, a door latch bolt 10 is shown as coupled to mechanism 11 which translates rotation of polygonal shaft 12 into linear retraction of the latch bolt 10 from a keeper opening 13 in door frame 14. The latch bolt is carried by the door 15, which swings in direction 16 during door closing. Guide shoulders for the latch bolt appear at 17 and 18.

Figure 1:
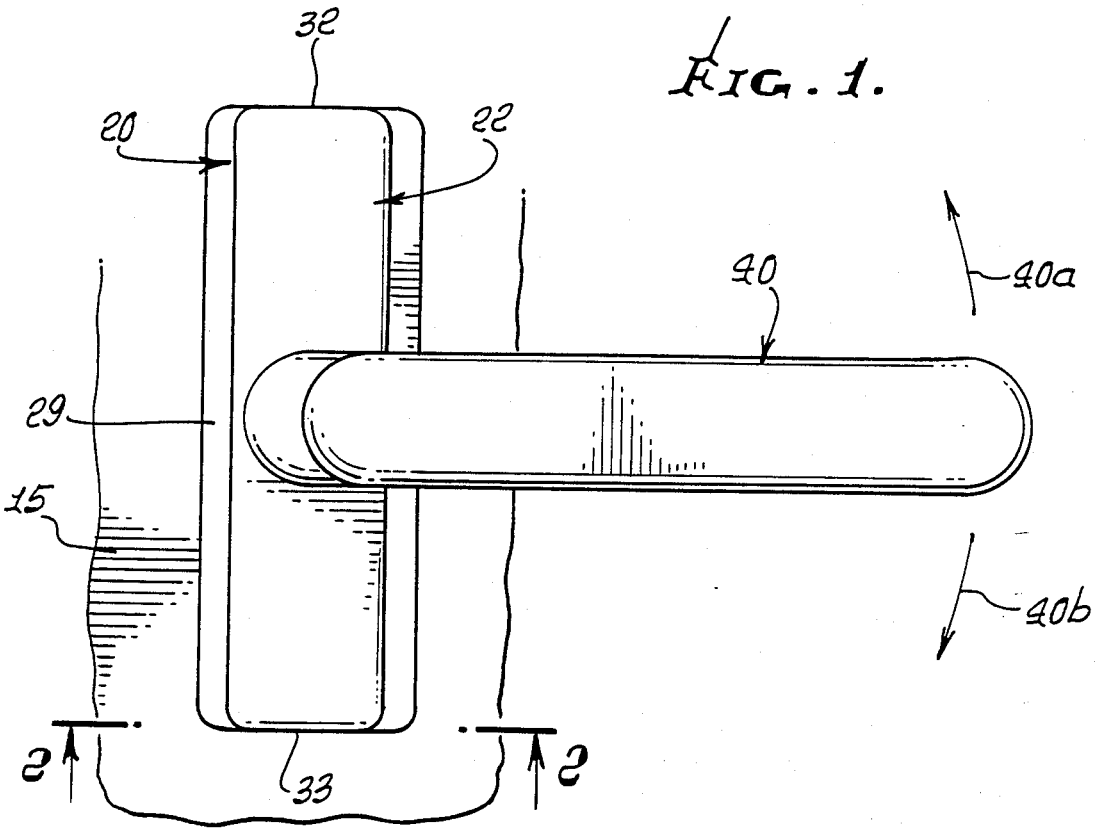
FIG. 1 is a front elevation showing the door handle and latch actuating mechanism.
Figure 2:
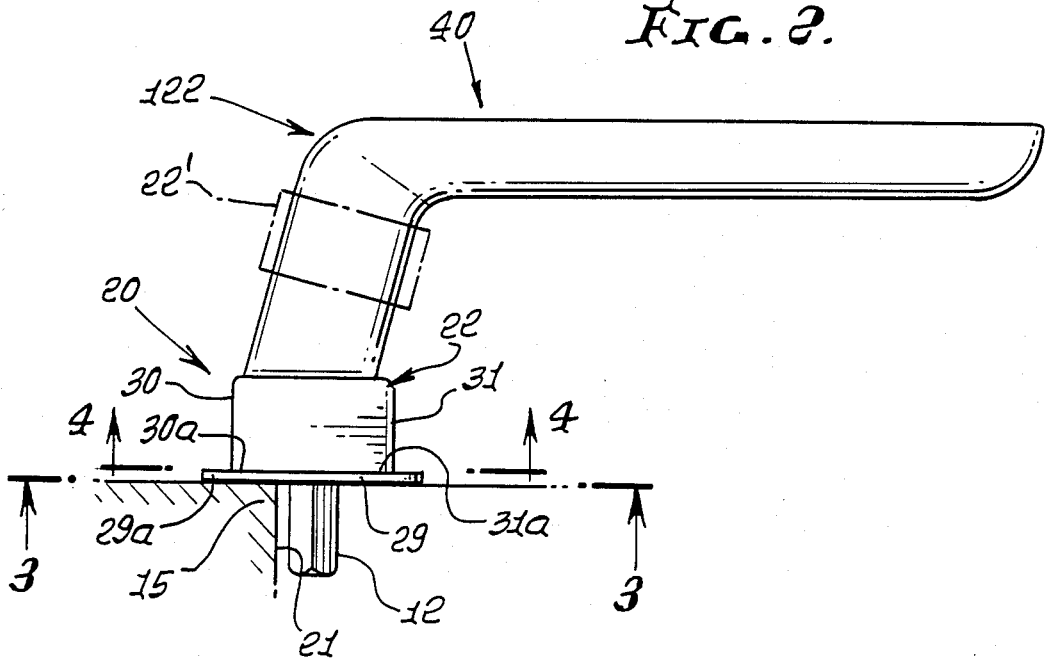
FIG. 2 is an end elevation taken on lines 2—2 of FIG. 1.
Figure 3:
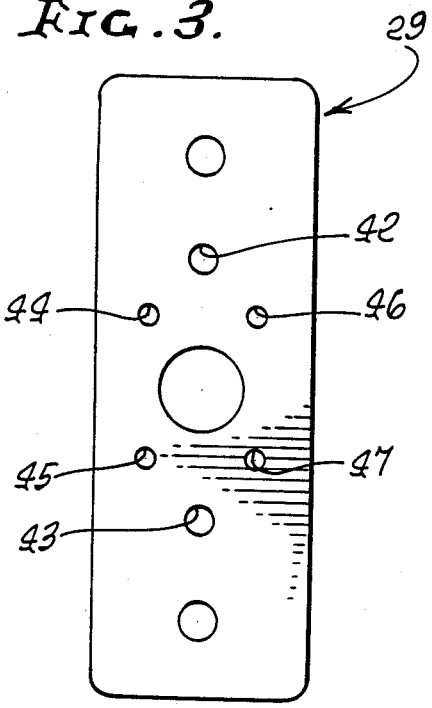
FIG. 3 is a rear elevation on lines 3—3 of FIG. 2, showing a trim plate.
Figure 6:
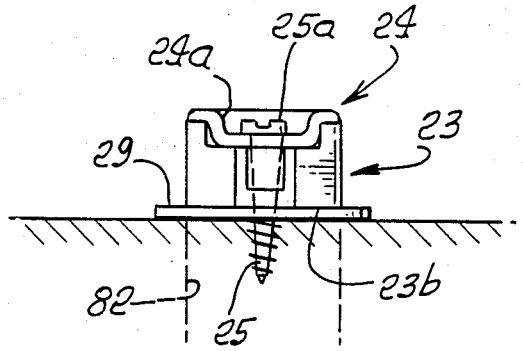
FIG. 6 is an end elevation on lines 6—6 of FIG. 5.
Figure 7:
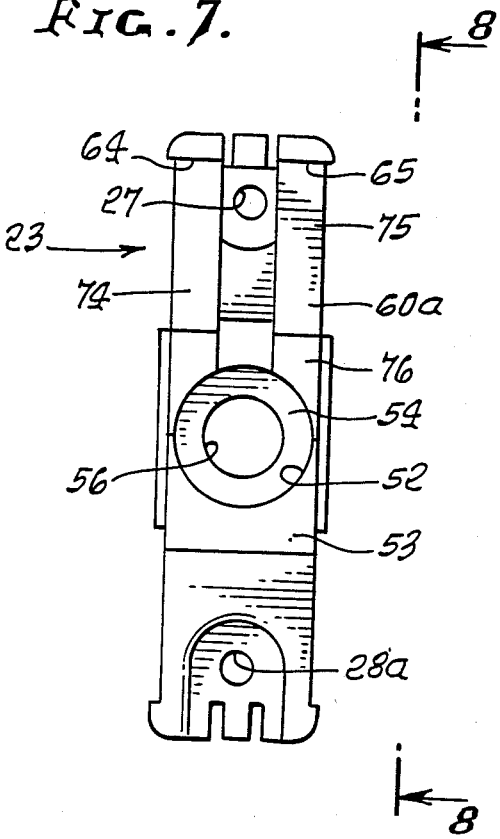
FIG. 7 is a view like FIG. 5, but showing a unitary mounting part of the body structure after removal of a retainer bracket.

Referring to FIGS. 1 and 2, the shaft 12 projects from a housing 20 attachable to the side of the door 15, whereby the shaft extends into the door at 21 for coupling to mechanism 11. The housing includes an anodized shell 22, a molded plastic body part or insert 23, and a metallic bracket 24 that is channel shaped in cross section and fits closely over the part 23 to encapsulate same, the shell fitting closely and frictionally over the bracket. These elements are longitudinally elongated, as for vertical orientation when connected to the door, and fasteners such as screws 25 seen in FIG. 6 pass through registered openings 26 and 27, and 28 and **28*a* in the bracket 24 and part 23 for retaining the bracket and part 23 to the door. The bracket 24 is re-entrantly recessed or deformed at two locations 24*a* to receive the fastener head 25*a*, which clamps the bracket and insert part 23. A thin cover plate 29 is also retained or sandwiched between the underside 23*b* of insert 23, and the door surface, and projects outwardly from the sides 30 and 31 of the shell, as at 29*a*, to cover an opening 82 cut in the door to receive the shaft 12 and the mechanism 11. Opposite end walls of the shell appear at 32 and 33**.

Figure 4:
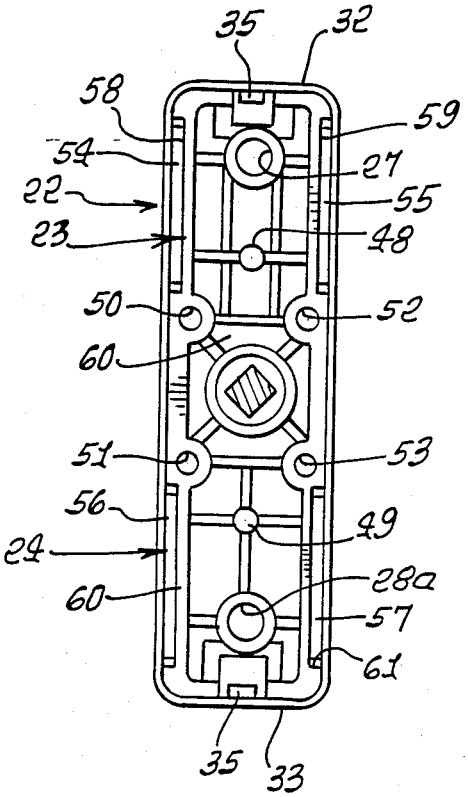
FIG. 4 is a rear elevation showing the rear side of body structure, taken on lines 4—4 of FIG. 2.
Figure 5:
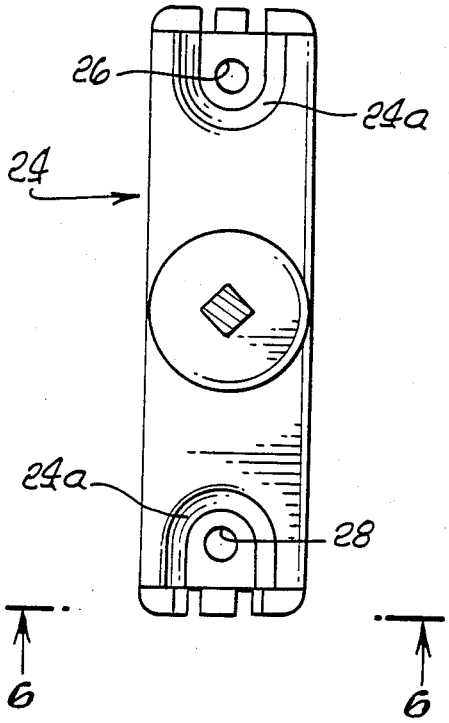
FIG. 5 is a front elevation showing the front side of the FIG. 4 body, structure, but after removal of a cover receptacle.

The molded plastic part 23 has stiff, cantilevered tangs 35 that projects adjacent the inner sides of shell end walls 32 and 33, for frictionally retaining the shell to the part 23, in installed condition. Note in FIG. 2 that the shell 22 may be installed as from a broken line position 22' to full line position 22, with shell edges **30*a*** and 31*a* engaging plate 29. Shell 22 preferably cannot be removed from the handle, as over bend 122. Insert part 23 has the lightweight, webbed interior construction at one side of an inner wall 60, as seen in FIG. 4. Plate 29 may be oriented to the part 23 as by use of small bosses protruding through openings 42–43 in the plate and projecting as from 48–49 in the webbed structure of part 23. The side walls 54–57 of the metallic bracket 24 are fitted closely in side recesses 58–61 in the sides of the insert part 23.

Figure 9:
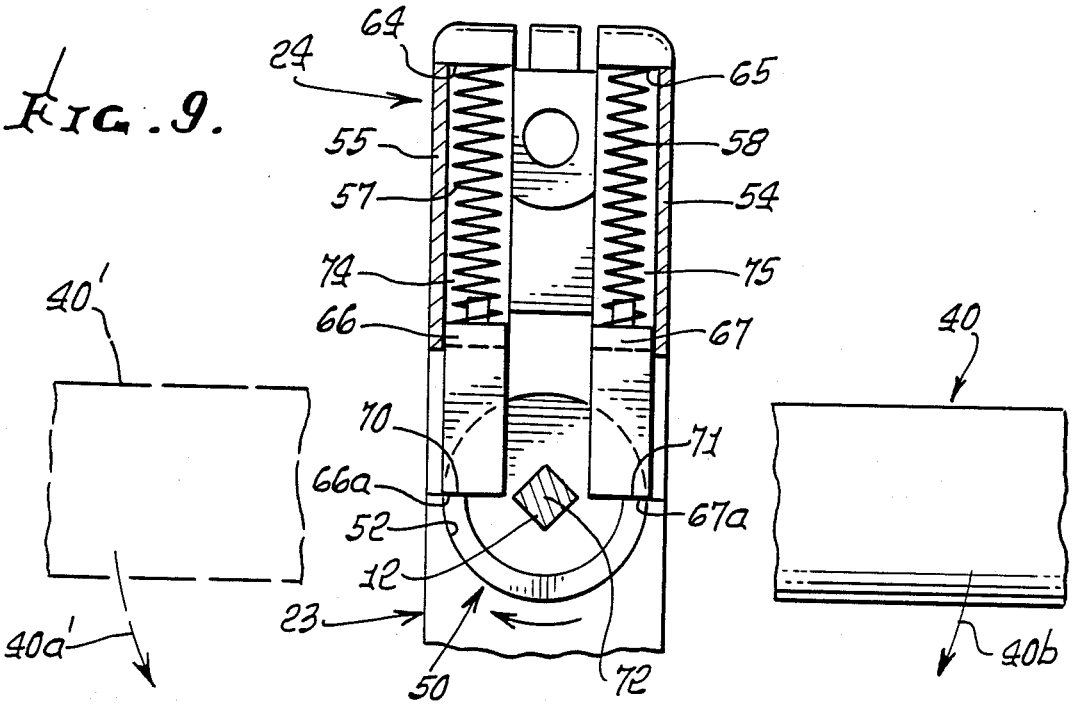
FIG. 9 is an enlarged view of two springs endwise positioned by two slides, for actuation of one spring by a handle rotated cam.

It is intended that the handle 40 be rotatable in either direction 40*a* and 40*b*, from neutral position as seen in FIG. 1, for opening of the latch. Typically, the housing 20 may be installed as shown in FIG. 1, with the handle extending to the right (as also indicated in FIG. 9), or with the handle extending to the left (see handle broken line position 40′ in FIG. 9). In the latter event, handle 40 is also rotated downwardly, as indicated at 40*a*′ in FIG. 9, and the housing 20 is installed endwise reversely from its position as seen in FIG. 1.

Figure 8:
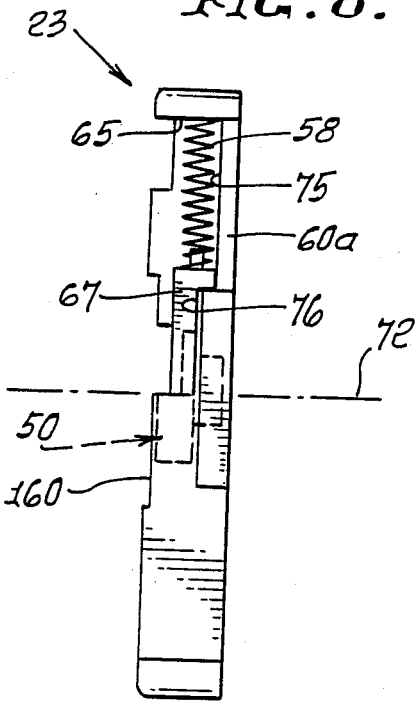
FIG. 8 is a side elevation on lines 8—8 of FIG. 7, and showing a spring endwise positioned by a slider.
Figure 10:
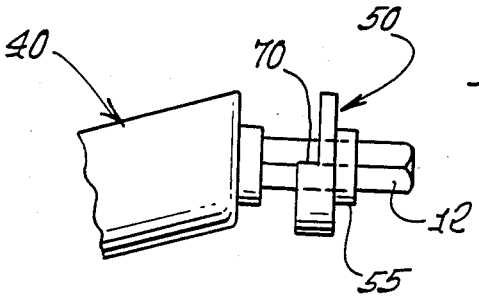
FIG. 10 is a side elevation showing handle connection to the cam.

Mechanism is provided in the housing to yieldably resist handle rotation in either direction, as referred to. Such mechanism includes a rotor, as for example is indicated at 50, integral with shaft 12, to be rotated by the handle which is also integral with the handle; and two springs coupled to the rotor and installed in the body insert part 23, at the opposite side of insert inner wall portion 60*a* that is offset from wall 160. See FIG. 8. The rotor 50 fits within a cylindrical cavity 52 in the central portion 53 of the part 23, and engages a ledge 54 formed in the cavity. A smaller diameter bearing surface 55 on the rotor fits within a cylindrical recess 56 in part 23, for providing additional bearing and guiding support for the rotor.

Figure 12:
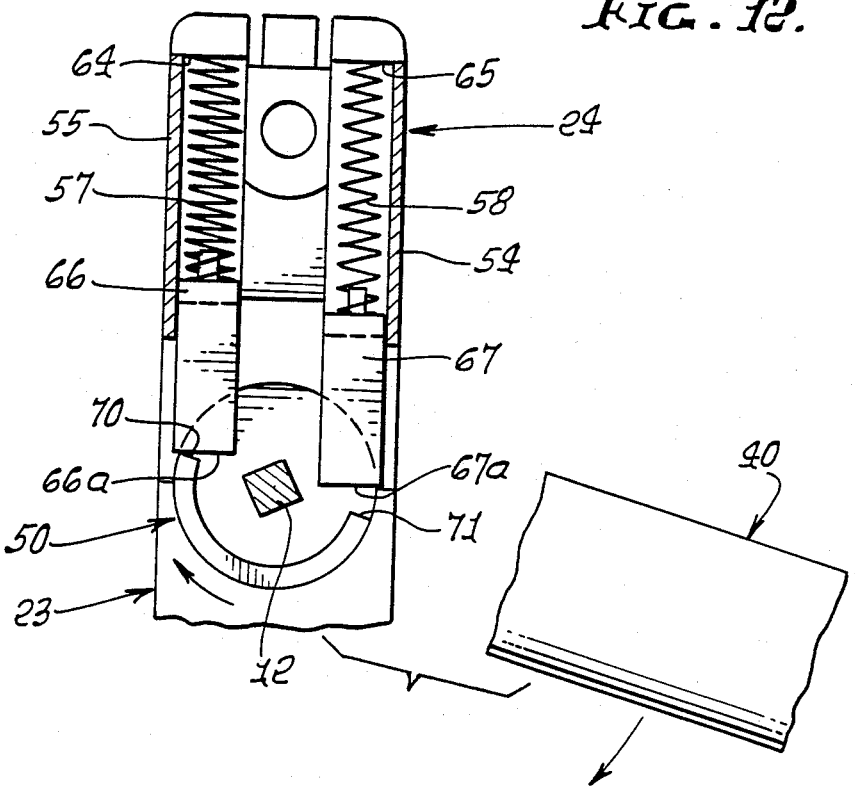
FIG. 12 is a view like FIG. 9, showing spring positions during handle rotation.

The two compression springs 57 and 58 extend lengthwise of the part 23, and are respectively retained compressively between shoulders 64 and 65 defined by that part at one end thereof and two plungers 66 and 67 that are bodily displaceable by the rotor. The springs, being alike, act to transmit force for holding the rotor, handle and shaft 12 in neutral position, as seen in FIG. 1, and returning the handle to neutral position. Also, as the handle 40 is rotated downwardly in FIG. 12, spring 57 is compressed, whereas spring 58 is inactive and relieved of compression; and when the handle in 40′ position is rotated downwardly in FIG. 9, spring 58 is compressed, and spring 57 is inactive and relieved. Also, if the device is installed so that spring 57 is compressed in use, as first referred to, then if spring 57 breaks after extended use (years of use) of the mechanism, spring 58 can be substituted for it, if desired.

Note the cam shoulders 70 and 71 on the rotor, at opposite sides of the rotor axis 72, that engage the ends 66*a* and 67*a* of the two plungers. The two plungers are guided in their sliding, as by wall surfaces 74 and 75 of the insert part 23, and also by stepped surfaces 76, extending longitudinally. Accordingly, each plunger has corresponding elongated guiding extent between its associated cam shoulder and spring.

Accordingly, a very simple, rugged, easily assembled unit is provided, with two springs, one of which may be substituted for the other, if need be.

I claim:

1. A door latch actuating mechanism, the combination comprising:
   (a) a housing attachable to door structure,
   (b) a handle carried by the housing for rotation in either of two directions, and an output shaft rotatable in response to handle rotation,
   (c) and mechanism in the housing to yieldably resist handle rotation in either direction, said mechanism including
      (i) a rotor coupled to the handle to rotate therewith,
      (ii) a first spring coupled to the rotor to resist rotor rotation in one direction, and
      (iii) a second spring coupled to the rotor to resist rotor rotation in the opposite direction,
   (d) said springs being everywhere spaced apart and coupled to different portions of the rotor, whereby the second spring is inactive when the rotor is rotated in said one direction, and said first spring is inactive when the rotor is rotated in said opposite direction,
   (e) the housing being longitudinally elongated, and said springs extending generally longitudinally, in laterally spaced relation in the housing, the housing including a shell, and an insert in the shell mounting said springs and said rotor,
   (f) the rotor having an axis and two cam shoulders, and including plungers extending between the ends of the respective springs and said cam shoulders defined by the rotor, the cam shoulders located at opposite sides of the rotor axis,
   (g) there being longitudinally extending stepped guides on the insert to guide each plunger as it is moved longitudinally relative to the insert by a cam shoulder, that plunger having elongated guiding extent between its associated cam shoulder and spring.

2. The combination of claim 1 wherein said springs are compression type coil springs extending linearly away from the rotor, in the housing.

3. The combination of claim 1 wherein the shell is metallic and said insert consists of molded plastic material.

4. The combination of claim 3 wherein said handle is metallic, and said handle and shell have anodized outer surfaces.

5. The combination of claim 3 wherein the shell is channel shaped, and the shell and insert are longitudinally elongated.

6. The combination of claim 3 wherein the shell is anodized and is frictionally retained to the insert.

7. The combination of claim 3 including a channel shaped metallic bracket within which the insert is received, the bracket and insert both frictionally retained within the shell, the insert consisting of molded plastic material.

8. The combination of claim 7 wherein the insert and bracket define openings to pass fasteners for fastening to a door, the fasteners concealed within the shell, the shell removable off the handle.

9. The combination of claim 7 wherein the shell has an open side and including an anodizable trim plate loosely covering such shell open side to conceal the bracket and insert in the shell, the shell removable off the bracket while retained on the handle.

* * * * *